US010907438B2

(12) United States Patent
Deng et al.

(10) Patent No.: US 10,907,438 B2
(45) Date of Patent: Feb. 2, 2021

(54) MULTI-LAYER BACKUP RING

(71) Applicants: Guijun Deng, The Woodlands, TX (US); Alexander Kendall, Houston, TX (US)

(72) Inventors: Guijun Deng, The Woodlands, TX (US); Alexander Kendall, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/749,703

(22) Filed: Jan. 22, 2020

(65) Prior Publication Data

US 2020/0232298 A1 Jul. 23, 2020

Related U.S. Application Data

(63) Continuation-in-part of application No. 16/395,459, filed on Apr. 26, 2019, now Pat. No. 10,677,014, and (Continued)

(51) Int. Cl.
*E21B 33/12* (2006.01)
*E21B 23/06* (2006.01)
(Continued)

(52) U.S. Cl.
CPC ..... *E21B 33/1216* (2013.01); *E21B 23/01* (2013.01); *E21B 23/06* (2013.01); *E21B 33/12* (2013.01); *E21B 33/128* (2013.01)

(58) Field of Classification Search
CPC ..... E21B 23/01; E21B 23/06; E21B 33/12; E21B 33/1216
See application file for complete search history.

(56) References Cited

U.S. PATENT DOCUMENTS 2,726,722 A 12/1955 Baker
2,767,795 A 10/1956 Bush
(Continued)

FOREIGN PATENT DOCUMENTS

AU 2015397127 B2 12/2016
EP 1197632 A2 4/2002
(Continued)

OTHER PUBLICATIONS

Notification of Transmittal of the International Search Report and the Written Opinion of the International Searching Authority, or the Declaration; PCT/US2020/019872; dated Jun. 19, 2020; 13 pages.
(Continued)

*Primary Examiner* — Tara Schimpf
(74) *Attorney, Agent, or Firm* — Cantor Colburn LLP

(57) ABSTRACT

A backup ring assembly has a plurality of radially offset ring members including an outermost ring member formed from plurality of axially extending segments. Each of the plurality of axially extending segments includes an outer surface. A first interlock member support is coupled to the outer surface of one of the plurality of axially extending segments of the outer most ring member. A second interlock member support is coupled to the outer surface of an another one of the plurality of axially extending segments of the outermost ring member. An interlock member includes a first end supported at the first interlock member support and a second end supported at the second interlock member support. The interlock member restrains radially outward expansion of the ring and circumferential expansion of a gap extending between the one of the axially extending segments and the another one of the axially extending segments.

7 Claims, 17 Drawing Sheets

Related U.S. Application Data a continuation-in-part of application No. 16/367,341, filed on Mar. 28, 2019, and a continuation-in-part of application No. 15/701,015, filed on Sep. 11, 2017, now Pat. No. 10,689,942.

(51) Int. Cl.
*E21B 23/01* (2006.01)
*E21B 33/128* (2006.01)

(56) References Cited

U.S. PATENT DOCUMENTS 2,797,759 A 7/1957 Long et al.
2,885,009 A 5/1959 Baker
2,921,633 A 1/1960 Baker
2,945,541 A 7/1960 Maly et al.
3,229,767 A 1/1966 Carter
3,298,440 A 1/1967 Current
3,313,553 A 4/1967 Gastineau
3,343,607 A 9/1967 Current
3,358,766 A 12/1967 Current
3,381,969 A 5/1968 Crow et al.
3,385,679 A 5/1968 Current
3,481,611 A 12/1969 Stratton
3,517,742 A 6/1970 Williams
3,960,311 A 6/1976 Griffiths
4,204,690 A 5/1980 Holland et al.
4,349,204 A 9/1982 Malone
RE31,933 E 7/1985 Taylor et al.
4,665,978 A 5/1987 Luke
4,753,444 A 6/1988 Jackson et al.
4,765,404 A 8/1988 Bailey et al.
4,852,394 A 8/1989 Lazes
4,892,144 A 1/1990 Coone
4,910,832 A 3/1990 Schaub et al.
5,027,894 A 7/1991 Coone et al.
5,161,806 A 11/1992 Balsells
5,311,938 A 5/1994 Hendrickson et al.
5,678,635 A * 10/1997 Dunlap ..... E21B 23/01 166/123
6,318,482 B1 11/2001 Fidtje
6,431,274 B1 7/2002 Tedham et al.
6,513,600 B2 2/2003 Ross
6,581,682 B1 6/2003 Parent et al.
6,598,672 B2 7/2003 Bell et al.
6,695,050 B2 2/2004 Winslow et al.
6,695,051 B2 2/2004 Smith et al.
6,712,153 B2 3/2004 Turley et al.
6,769,491 B2 8/2004 Zimmerman et al.
6,840,328 B2 1/2005 McKee et al.
7,124,826 B2 10/2006 Simpson
7,178,601 B2 2/2007 Burge
7,273,110 B2 9/2007 Pedersen et al.
7,306,034 B2 12/2007 Garcia
7,341,110 B2 3/2008 Doane et al.
7,424,909 B2 9/2008 Roberts et al.
7,665,516 B2 2/2010 Roberts et al.
7,708,080 B2 5/2010 Conaway et al.
7,780,399 B1 8/2010 Garrison
8,151,873 B1 4/2012 Lee et al.
8,151,894 B2 4/2012 Nutley et al.
8,205,671 B1 6/2012 Branton
8,276,678 B2 10/2012 Burnett et al.
8,327,929 B2 12/2012 Reid et al.
8,403,036 B2 3/2013 Neer et al.
8,469,088 B2 6/2013 Shkurti et al.
8,479,809 B2 7/2013 Farquhar
8,662,161 B2 3/2014 Lee et al.
8,701,787 B2 4/2014 Shkurti et al.
8,839,874 B2 9/2014 Bishop et al.
9,140,094 B2 9/2015 Lee et al.
9,194,206 B2 11/2015 Xu et al.
9,260,936 B1 2/2016 Branton
9,587,458 B2 3/2017 Derby
9,845,658 B1 12/2017 Nish et al.
10,087,704 B2 10/2018 Conner et al.
10,435,972 B2 10/2019 Crump et al.
2002/0043368 A1 4/2002 Bell et al.
2003/0037932 A1 3/2003 Guillory et al.
2003/0226659 A1 12/2003 Smith et al.
2004/0134659 A1 7/2004 Hoffman et al.
2004/0150165 A1 8/2004 Grondahl et al.
2005/0189103 A1 9/2005 Roberts et al.
2006/0289173 A1 12/2006 Conaway et al.
2007/0125532 A1 6/2007 Murray et al.
2007/0200299 A1 8/2007 Kunz
2007/0256827 A1 11/2007 Guerrero et al.
2007/0261863 A1* 11/2007 MacLeod ..... E21B 33/1293 166/387
2008/0041583 A1 2/2008 Angman et al.
2008/0060821 A1 3/2008 Smith et al.
2008/0061510 A1 3/2008 Li et al.
2008/0135240 A1 6/2008 Brennan et al.
2008/0190600 A1 8/2008 Shkurti et al.
2009/0065191 A1 3/2009 Reid et al.
2009/0159265 A1 6/2009 Freyer
2009/0255690 A1 10/2009 Conner et al.
2009/0277648 A1 11/2009 Nutley et al.
2009/0283254 A1 11/2009 Andersen et al.
2009/0308592 A1 12/2009 Mercer et al.
2010/0038074 A1 2/2010 Patel
2010/0186970 A1 7/2010 Burnett
2010/0276137 A1 11/2010 Nutley et al.
2010/0294485 A1 11/2010 Lynde et al.
2011/0037229 A1 2/2011 Clarke
2011/0101615 A1 5/2011 Clarke et al.
2011/0297368 A1 12/2011 Lembcke
2012/0018143 A1 1/2012 Lembcke
2012/0037355 A1 2/2012 Bishop et al.
2012/0073830 A1 3/2012 Lembcke et al.
2012/0133098 A1 5/2012 Farquhar
2012/0145412 A1 6/2012 Andersen et al.
2012/0217025 A1 8/2012 Shkurti et al.
2012/0305236 A1 12/2012 Gouthaman
2013/0147120 A1 6/2013 O'Malley
2013/0213672 A1 8/2013 Nutley et al.
2013/0306330 A1 11/2013 Bishop et al.
2013/0306331 A1 11/2013 Bishop et al.
2014/0034335 A1 2/2014 Nutley et al.
2014/0262351 A1 9/2014 Derby
2014/0265161 A1 9/2014 Sutterfield et al.
2014/0290946 A1 10/2014 Nguyen et al.
2015/0101796 A1 4/2015 Davies et al.
2015/0115539 A1 4/2015 Guenther et al.
2015/0308214 A1 10/2015 Bilansky et al.
2015/0330174 A1 11/2015 Craigon et al.
2015/0354313 A1 12/2015 McClinton et al.
2016/0109025 A1 4/2016 McCarrey et al.
2016/0208632 A1 7/2016 Davis et al.
2016/0369586 A1 12/2016 Morehead et al.
2016/0376869 A1 12/2016 Rochen et al.
2017/0191340 A1 7/2017 Dent et al.
2017/0342797 A1 11/2017 Murphree et al.
2018/0010418 A1 1/2018 Vanlue
2018/0023366 A1 1/2018 Deng et al.
2018/0106125 A1 4/2018 Deng et al.
2018/0298716 A1 10/2018 Cayson et al.
2018/0298718 A1 10/2018 Cayson et al.
2018/0320473 A1 11/2018 Xu et al.
2019/0017347 A1 1/2019 Kendall et al.
2019/0040710 A1 2/2019 Deng et al.
2019/0078413 A1 3/2019 Kendall et al.
2019/0120011 A1 4/2019 Kellner
2019/0169951 A1 6/2019 Frazier
2019/0249511 A1 8/2019 Deng et al.
2019/0345791 A1 11/2019 Kendall et al.
2019/0352997 A1 11/2019 Brown
2019/0368304 A1 12/2019 Deng et al.

(56) References Cited

U.S. PATENT DOCUMENTS

FOREIGN PATENT DOCUMENTS

| | | | |
|---|---|---|---|
| WO | 2006046075 | A2 | 5/2006 |
| WO | 2006121340 | A1 | 11/2006 |
| WO | 2009074785 | A2 | 6/2009 |
| WO | 2013128222 | A1 | 9/2013 |

OTHER PUBLICATIONS

Notification of Transmittal of the International Search Report; PCT/US2018/050395; dated Jan. 2, 2019; 5 pages.
Notification of Transmittal of the International Search Report and the Written Opinion of the International Searching Authority, or the Declaration; PCT/US2018/027359; dated Aug. 1, 2018; 11 pages.
Notification of Transmittal of the International Search Report and the Written Opinion of the International Searching Authority, or the Declaration; PCT/US2018/041880; dated Nov. 21, 2018; 13 pages.

* cited by examiner

MULTI-LAYER BACKUP RING

CROSS REFERENCE TO RELATED APPLICATIONS

The present application is a continuation-in-part of U.S. patent application Ser. No. 16/367,341, filed on Mar. 28, 2019, and a continuation-in-part of U.S. patent application Ser. No. 15/701,015 filed Sep. 11, 2017, and a continuation-in-part of U.S. patent application Ser. No. 16/395,459 filed on Apr. 26, 2019, of which is hereby incorporated in its entirety herein.

BACKGROUND

In the drilling and completion industry, often times wells have multiple production zones. Production zones are typically isolated one from another through the use of a deployable seal or packer. Typically, there is a need for multiple packers to provide isolation both above and below the production zones. A packer typically includes of a cylindrical elastomeric element that is compressed axially, or set, from one end or both by gage rings within a backup system that cause the elastomer to expand radially and form a seal in the annular space.

Gage rings are compressed axially with various setting mechanisms, including mechanical tools from surface, hydraulic pistons, atmospheric chambers, etc. Setting typically requires a fixed end for the gages to push against. These fixed ends are often permanent features of a mandrel but can include other systems. When compressed, the elastomeric seal has a tendency to extrude past the gage rings. The art would welcome new systems that promote expansion of packers while, at the same time, reducing extrusion.

SUMMARY

Disclosed is a backup ring assembly having a plurality of radially offset ring members including an outermost ring member formed from plurality of axially extending segments. Each of the plurality of axially extending segments includes an outer surface. A first interlock member support is coupled to the outer surface of one of the plurality of axially extending segments of the outer most ring member. A second interlock member support is coupled to the outer surface of an another one of the plurality of axially extending segments of the outermost ring member. An interlock member includes a first end supported at the first interlock member support and a second end supported at the second interlock member support. The interlock member restrains radially outward expansion of the ring and circumferential expansion of a gap extending between the one of the axially extending segments and the another one of the axially extending segments.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 4:
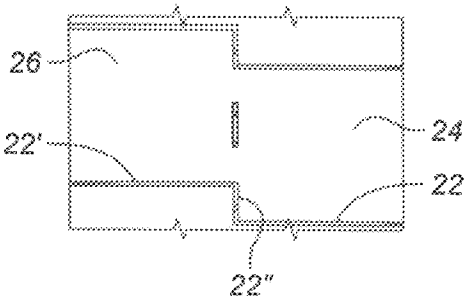
FIG. 4 is the view along line 4-4 of FIG. 2.
Figure 2:
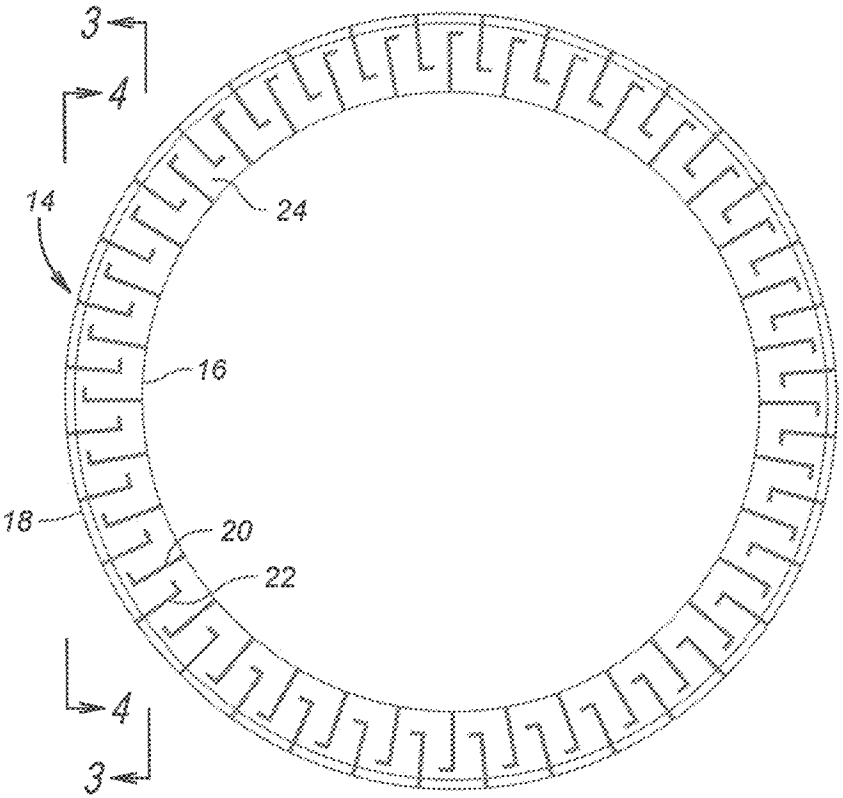
FIG. 2 is a side view of the ring of FIG. 1.
Figure 1:
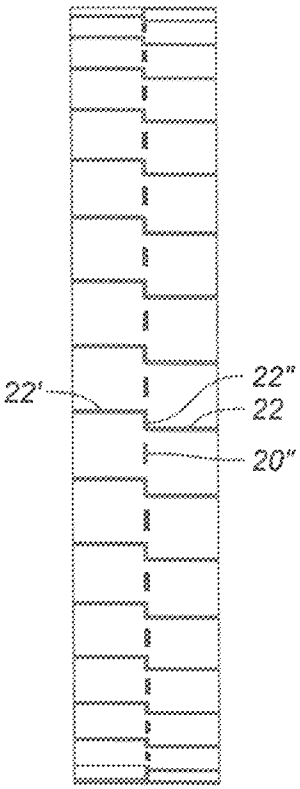
FIG. 1 is a front view of a backup ring in a run in position.
Figure 5:
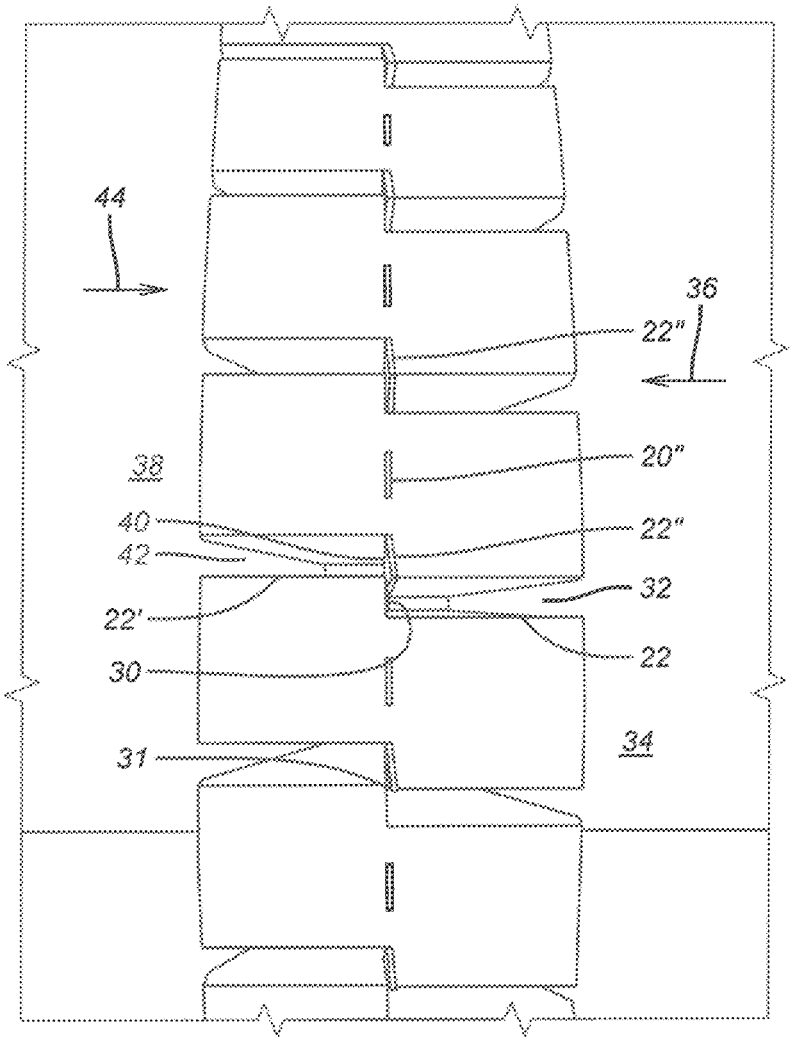
FIG. 5 is an outside diameter view of the backup ring in an expanded position.
Figure 10:
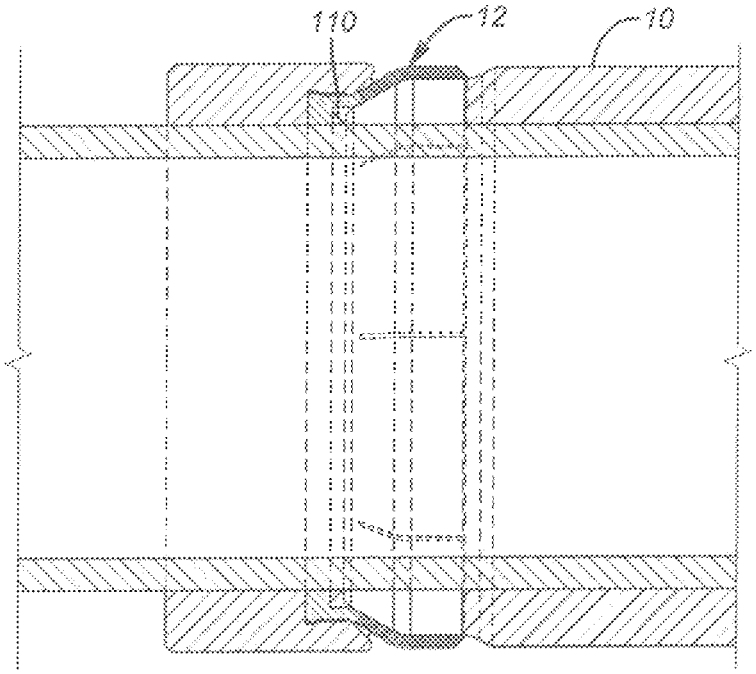
FIG. 10 is a section view of the backup ring of FIG. 8 in a run in position.
Figure 11:
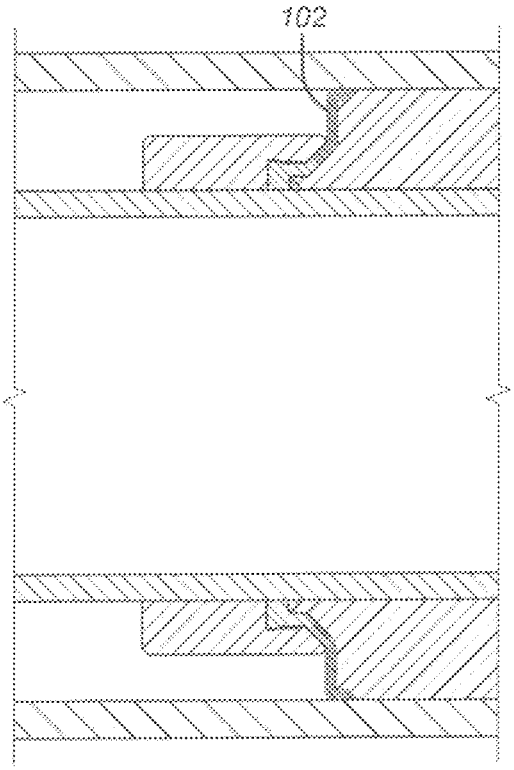
FIG. 11 is the view of FIG. 10 in the set position.

FIGS. 10 and 11 illustrate the juxtaposition of a sealing element 10 next to a backup ring 12. FIG. 2 shows an end view of a continuous single ring 14 that can be disposed next to a sealing element 10. Ring 14 has an inside diameter 16 and an outside diameter 18. There are alternating l-shaped slots 20 and 22 that start at the outside diameter 18 and at the inside diameter 16. FIG. 2 shows a tapered or sloping side 24 and slots 20 and 22 that alternate as to the location of the long dimension of the l-shaped slot. Sloping side 26 is not seen in FIG. 2 but is shown as FIG. 3 as well as the cylindrically shaped inside surface 28 that defines the inside diameter 16. FIGS. 1 and 4 both show an outside view where it is seen that slot 22 is a segment that goes to outside diameter 18 has a continuation slot segment 22' that is circumferentially offset a few degrees. Slots 22 and 22' are at opposed ends of an oblong bore 22" that may have internal supports. Bore or opening 22" is seen at an opposite end at inside diameter 16 in FIG. 3. When ring 14 is increased in both inside diameter 16 and outside diameter 18 the bore undergoes hoop stress and comes apart at outside diameter 18 when outside diameter 18 grows as shown in FIG. 5. The connecting bore 22" has sheared leaving surface 30 as a closing wall to a gap 32 that opens and into which the sealing element 34 can move. However, since the gap 32 is closed by surface 30, migration of the sealing element 32 in the direction of arrow 36 is stopped by surface 30. At the same time should there be a sealing element 38 on an opposite side of ring 14, the searing apart of bore 22" at the outside diameter 18 also leaves surface 40 at the end of gap 42 to stop movement of seal 38 in the direction of arrow 44.

Figure 3:
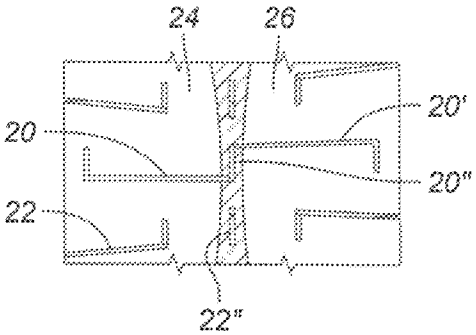
FIG. 3 is the view along line 3-3 of FIG. 2.
Figure 6:
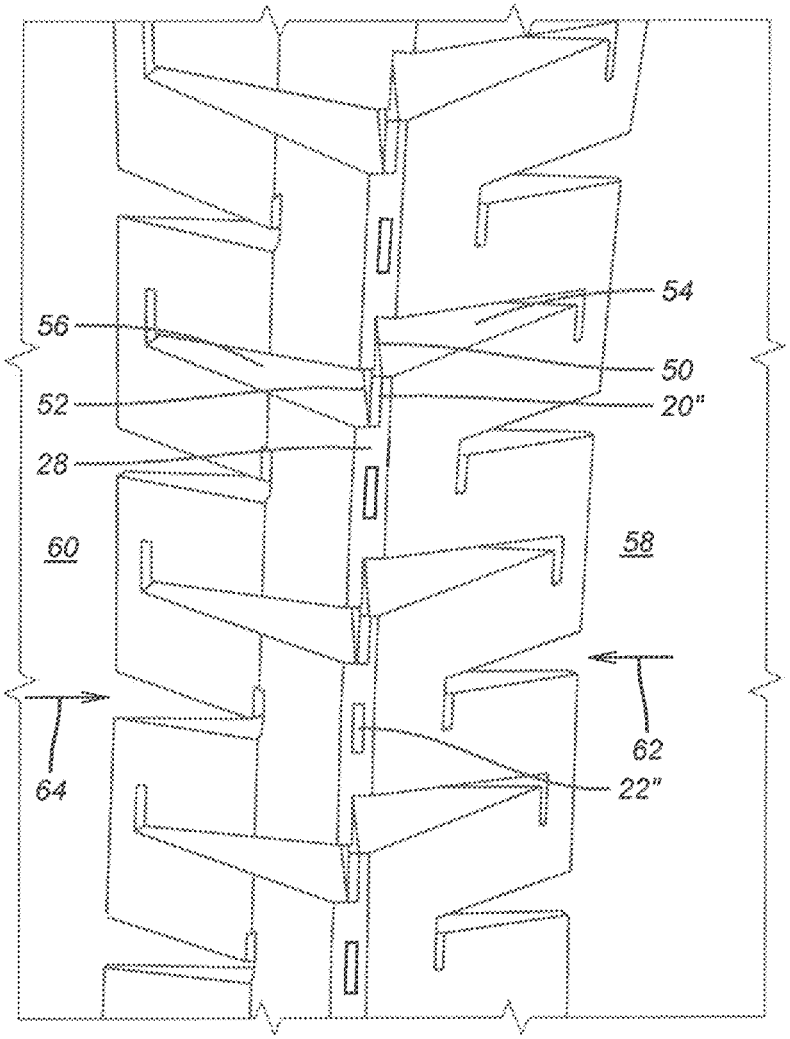
FIG. 6 is an inside diameter view of the backup ring in the expanded position.

Bores 20" are seen as alternating with bores 22" at the outside diameter 18 as seen in FIG. 1 and are seen at inside diameter 16 in FIG. 3 as connecting slots 20 and 20' in the run in condition. FIG. 6 shows bores 20" sheared from hoop stress during radial expansion of inside diameter 16. Surfaces 50 and 52 are presented respectively at the ends of widened slots 54 and 56 from the inside diameter 16 radial expansion. As a result, a sealing element 58 will be blocked from passing surface 50 in the direction of arrow 62 or/and a sealing element 60 will be blocked by surface 52 when moving in the direction of arrow 64 under differential pressure that would otherwise allowed for extrusion in gaps closed at the inside diameter by surfaces 50 and 52 as a result of shearing of bores or openings 20" at inside dimension 28. Note that at inside dimension 28 bores 22" do not shear as they are supported at that location by the ring structure unlike bores 20" that span slots 20 and 20' at inside dimension 28.

Note that as shown in FIG. 6 opposed surfaces 50 and 54 may separate circumferentially to leave a small gap or their ends can alternatively align or overlap and may also optionally involve a stop or overlap to limit the relative circumferential movement between surfaces such as 50 and 54 at inside surface 28 to insure that any gap such as 54 and 56 are fully closed at maximum condition for inside diameter 16. This is equally true at outside diameter 18 shown in FIG. 5 where surfaces 30 and 40 circumferentially separate to an end position where there is overlap between them, a small gap or alignment between their ends so that there is no effective gap in the directions of arrows 36 and 44. Alternatively opposed surfaces 30 and 40 can have one or move travel stops 31 to limit the amount of relative circumferential movement to an overlapping position as shown in FIG. 5.

Figure 7:
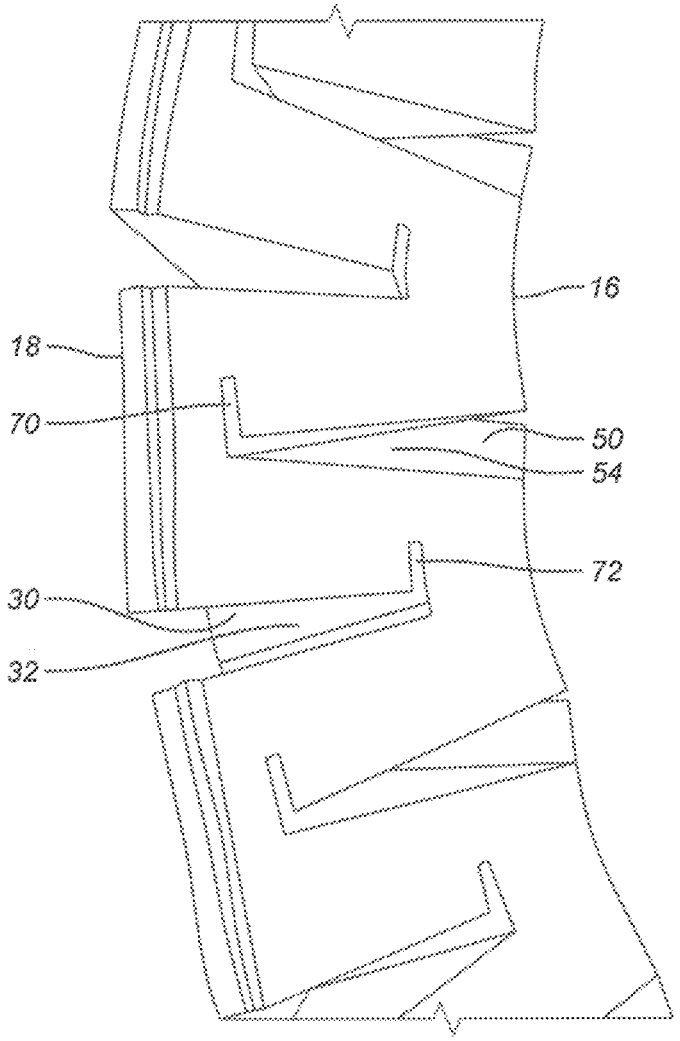
FIG. 7 is a side view of the backup ring in the expanded position.

FIG. 7 shows how surfaces 30 and 50 close off gaps 32 and 54 respectively when in the inside diameter 16 and the outside diameter 18 are increased. It also shows the short slot segments that make the l-shape 70 and 72 that are there to reduce stress concentration at ends of opening gaps such as 32 and 54, for example.

Figure 13:
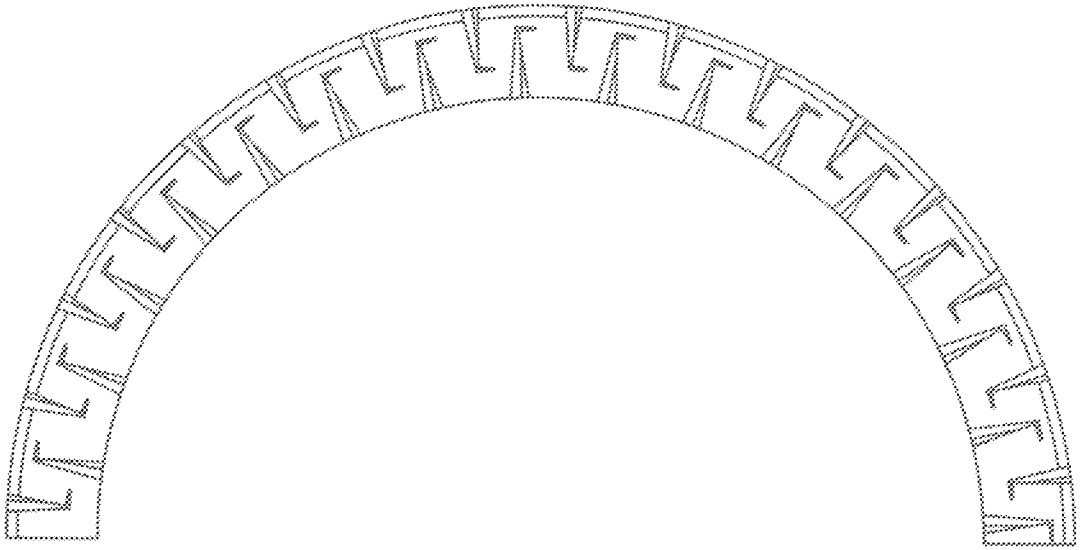
FIG. 13 is an expanded view of the view in FIG. 2.
Figure 12:
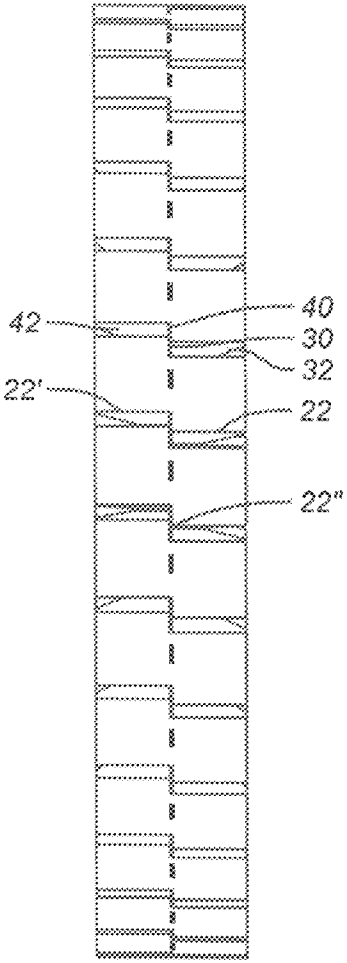
FIG. 12 is an expanded view of the view on FIG. 1.

FIG. 12 is similar to FIG. 5 and represents the gaps closed with end walls 30 and 40 after the inside and outside diameters are enlarged, as previously described. FIG. 13 is the view of FIG. 2 after the inside and outside diameters are enlarged graphically illustrating the alternating pattern of opened gaps on the inside diameter and the outside diameter with the extrusion gaps closed using a single ring that can grow in outside diameter, for example from 8.3 inches to 9.875 inches while closing extrusion paths.

Figure 17:
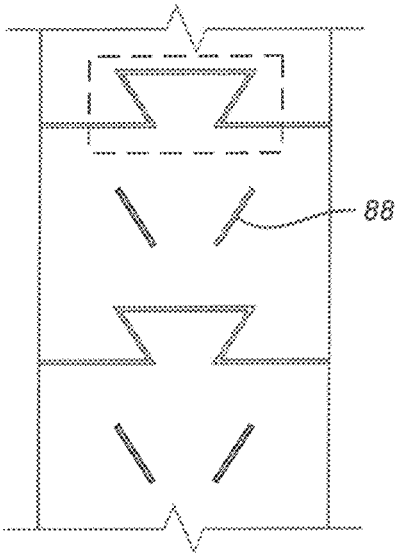
FIG. 17 is an alternative to the dog leg slot design in FIG. 1 using a dovetail configured to allow relative circumferential movement for an increase in diameter.
Figure 18:
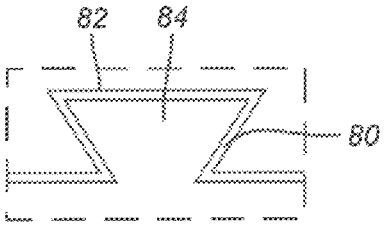
FIG. 18 is a close up view of FIG. 17 to show the dovetail has initial gaps to allow for the relative circumferential movement at the inside and the outside diameters.
Figure 19:
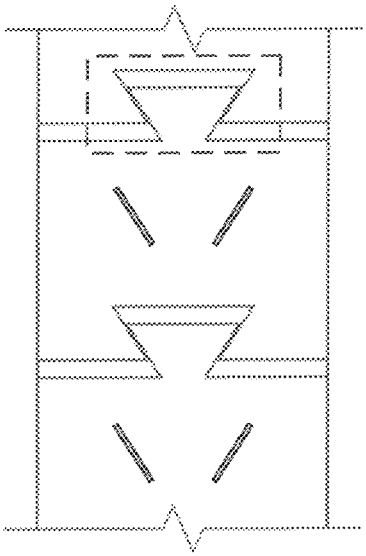
FIG. 19 is the view of FIG. 17 after the diameters are increased.
Figure 20:
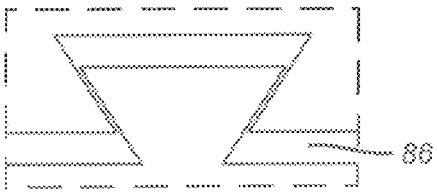
FIG. 20 is an enlarged view of FIG. 19 showing the dovetail acting as a relative circumferential movement travel stop and gap barrier at the same time.

FIGS. 17-20 are an alternative design using the concepts of the design in FIGS. 1-7 but instead of l-shaped slots with a dog leg that starts out as a bore but then shears to create relative circumferential movement to produce end walls to close gaps that enlarge at the inside and the outside diameters, uses slots that are interacting dovetail shapes that alternatively start at the inside diameter and the outside diameter and do not go all the way through. Diameter enlargement at the inside and the outside diameters is enabled in a relative circumferential direction until one part of the dovetail closes an initial dovetail gap. The dovetail limits the ring gaps and acts as an extrusion barrier by its presence in those enlarging gaps that open alternatingly from the inside and outside diameters. FIGS. 17 and 18 show the initial gaps 80 between the male 82 and the female 84 components of each dovetail. FIG. 20 shows gap 80 closed during diameter expansion at the inside and the outside diameters. An extrusion gap such as 86 opens but the male component 84 is in that gap to close it up. The same condition happens at the inside dimension and the outer dimension of the backup ring as previously described in the context of FIGS. 1-7. Bores 88 do not open on the outside diameter as between FIGS. 17 and 19 but on the inside diameter that is not shown for this variation there is relative circumferential movement until the counterpart dovetail on the inside diameter closes an initial dovetail gap that defines the end of relative circumferential movement where gaps open on the inside dimension. In the sense of alternating gaps that open from the inside and then the outside diameters the embodiments of FIGS. 1-7 and 17-20 operate the same way. Instead of bores shearing to enable circumferential growth the slack in dovetails closed to enable circumferential growth at the inside and the outside diameters. FIGS. 17-20 are schematic and can illustrate the view at an outer diameter or an inner diameter. The operating principle is the same as previously described for FIGS. 1-7 in that gaps alternatingly open up in a circumferentially offset manner on the inside and the outside dimensions and the gaps so created are then closed to seal element extrusion. In the case of FIGS. 1-7 a wall surface is interposed in the gap due to the alternating gaps opening up and in FIGS. 17-20 the dovetail itself allows the gaps to open up until slack in the dovetail is removed at which time the male portion of the dovetail is interposed in the gap to block it entirely or at least substantially.

Figure 14:
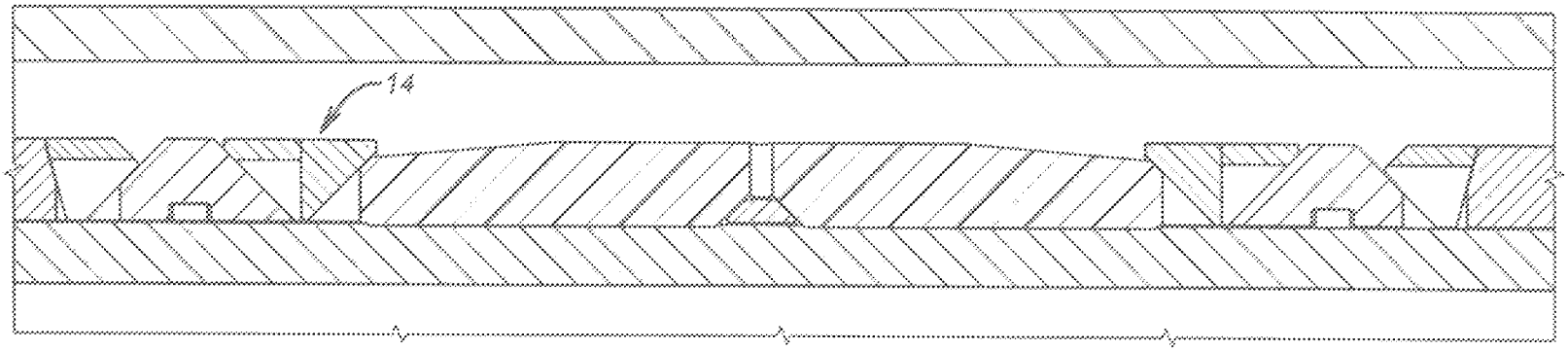
FIG. 14 is a section view of a packer in the run in position using the backup ring.
Figure 16:
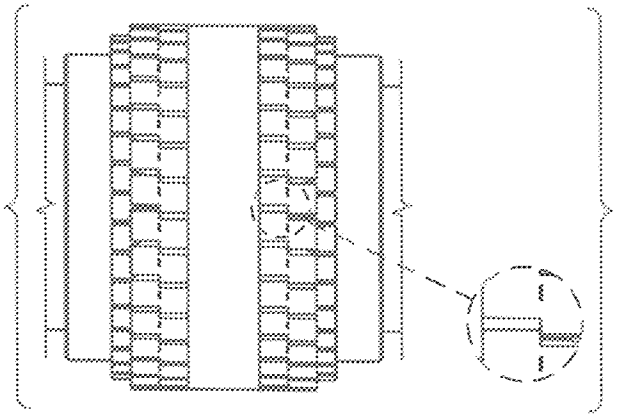
FIG. 16 is an exterior view of the view in FIG. 15.
Figure 15:
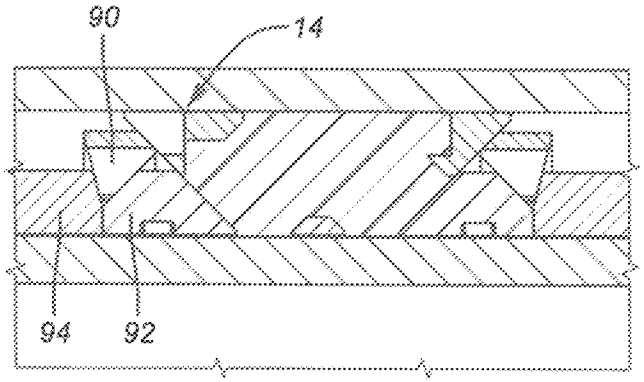
FIG. 15 is a set position of the view in FIG. 14.

FIGS. 14-16 show a typical packer in the run in and set positions using the ring 14 as a backup ring. FIG. 16 graphically shows how the dog leg slots that open on the outside diameter block the extrusion of the sealing element as previously described. Details of the operation of the rings 90, 92 and 94 can be reviewed in U.S. application Ser. No. 14/989,199 that is fully incorporated herein as if fully set forth. While that design featured alternating gaps opening on the inside diameter and the outside diameter, there was no feature of blocking the opened gaps against extrusion.

Figure 8:
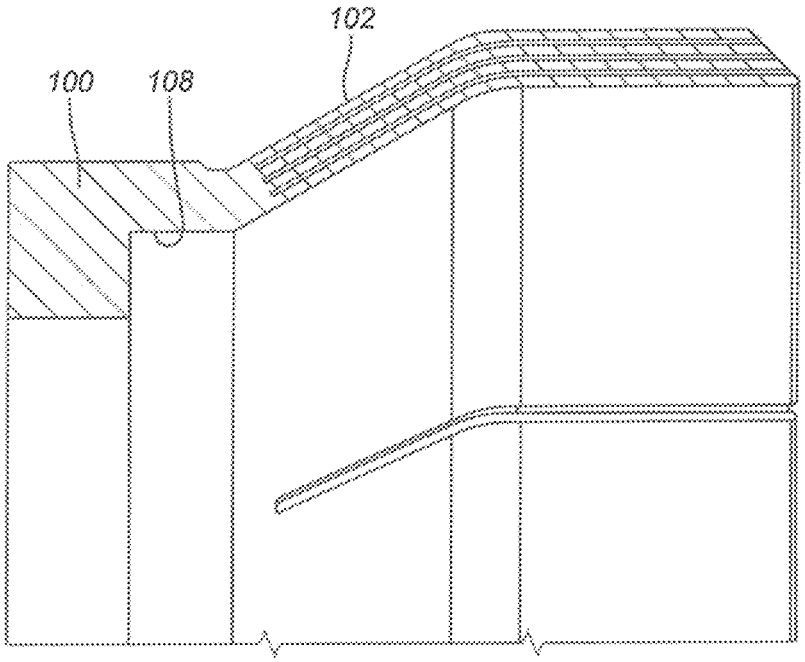
FIG. 8 is a section view of a backup ring showing the layers of ring segments extending from a common base.

FIG. 8 illustrates a backup ring design featuring a common base ring 100 that has multiple segmented rings 102 integrally extending therefrom, with 2-4 being preferred. The segmented nature of each ring can be seen in FIG. 9 in the form of offset gaps 104 and 106 in adjacent rings. Preferably there is a circumferential offset of about 12 degrees between gaps on adjacent rings. Each ring has multiple gaps that are all offset from gaps on an adjacent ring on either side. Because the segments that make up each ring are integrally connected to the base ring 100 there is no relative rotation among the stacked segmented rings 102 and the rings 102 are still flexible as seen by comparing FIGS. 10 and 11 for the run in and the set positions. Since the stacked rings 102 are supported circumferentially along the length of each ring segment from base 100 the assembly of rings also has greater resistance to extrusion when pushed against the surrounding tubular as shown in FIG. 11. Ring segments 102 extend to different or the same axial lengths for running in and have a free end that is offset and axially aligned with an axis of ring 100. Gaps 104 are as long axially as said segments 102 or shorter. An internal groove 108 holds a mandrel seal 110 to prevent extrusion of sealing element 10 along the mandrel.

Figure 9:
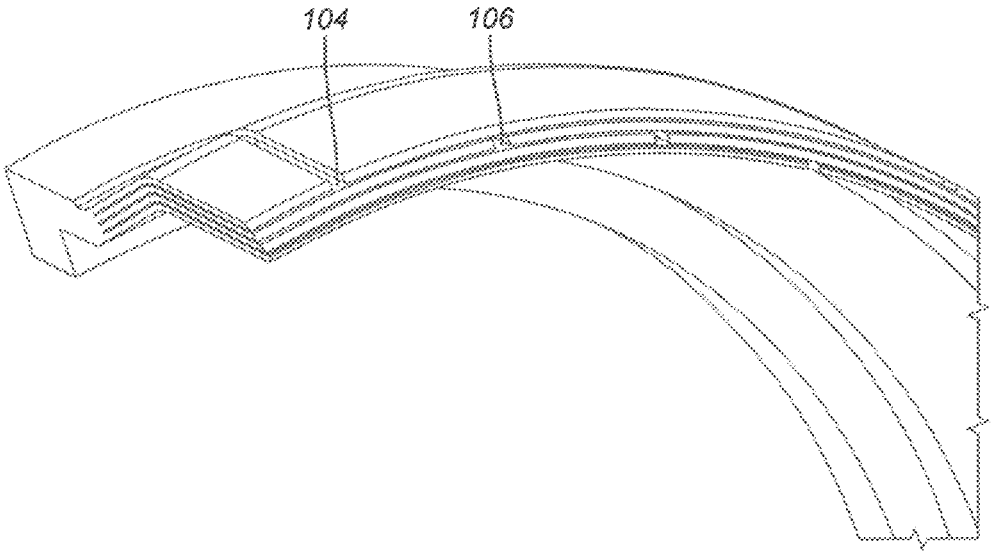
FIG. 9 is an isometric view of the backup ring of FIG. 8.
Figure 21:
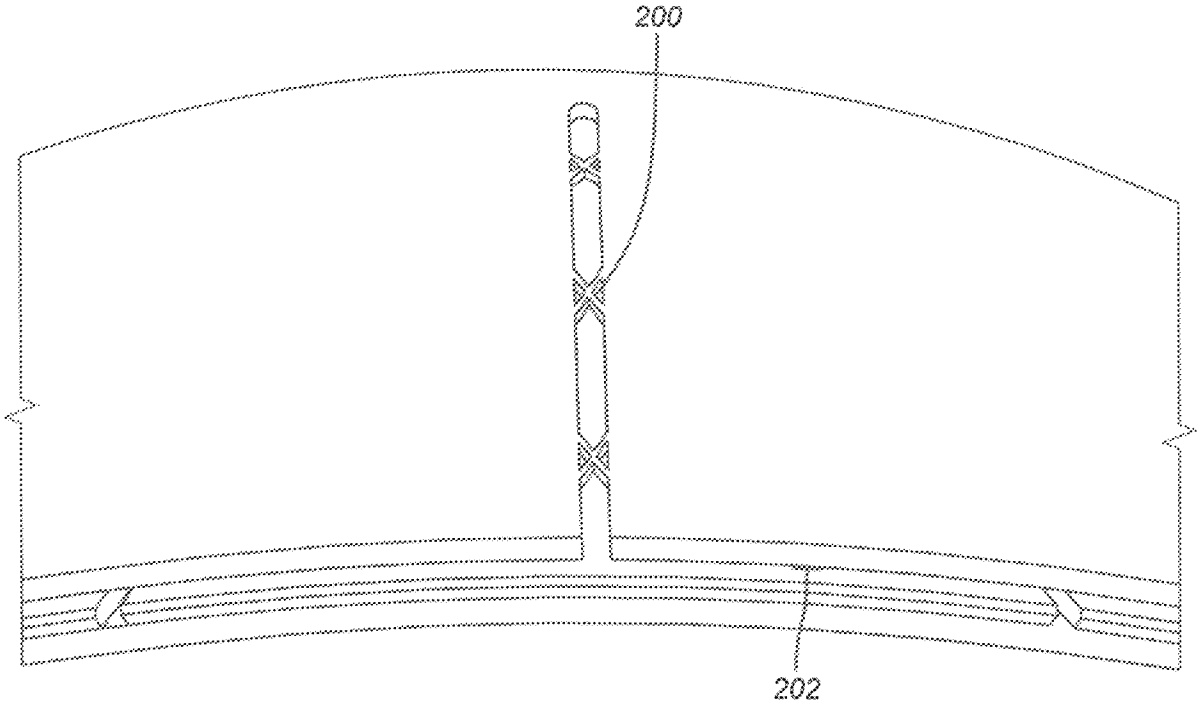
FIG. 21 is a modified version of FIG. 9 showing the use of removable ties in the gap or gaps in a given ring or between adjacent rings.

FIG. 21 shows ties 200 in one or more gaps 104 on one or more ring segments 102. The preferred ties 200 are shown in an X shape although other shapes are contemplated such as straight line(s), rounded shapes, quadrilateral or multilateral shapes. The material of the ties 200 or 202 is preferably the same as the segments 102 that define the rings. In a single gap 104 there can be a single or multiple ties 200 that are axially spaced as shown in FIG. 21. The presence of ties 200 provides several operational benefits. The packer can be run in the hole faster since the presence of the ties 200 in the gaps 104 gives each ring made of segments 102 a greater hoop strength against the force generated from relative movement of the ring made of segments 102 with respect to the surrounding well fluid. Another advantage is that the ties 200 resist residual stresses from the additive manufacturing process used to make the backup ring assembly shown in FIGS. 9 and 21. The residual stresses from that process could result in warping of parts of ring made of segments 102 between gaps such as 104 or 106. Ties 202 are schematically illustrated as between adjacent rings made of segments 102. Ties 202 can be used to provide greater strength between layers so they can act as a cohesive structure until the ties are broken during a setting of the packer. In essence the ties 202 can be distributed in a predetermined or random pattern and act as temporary support structures between pairs of rows of ring segments 102 that can fail preferably in shear when the packer is set. Although shown schematically between a single abutting pair of rows of ring segments 102, the ties can be present between multiple pairs of rows of ring segments 102. Ties 202 and be used exclusively as can ties 200 or a combination of those two types of ties can be combined in a single FIG. 9 structure. Their use reduces swabbing tendency of the backup ring during running in by incrementally strengthening the FIG. 9 structure against the fluid force generated from relative movement of the packer assembly being run in. Since the backup ring of FIG. 9 is made using the additive manufacturing process, the material of the rings of segments 102 and the ties 200 or 202 is preferably the same. The preferred mode of tie failure is in shear, although other failure modes and material dissimilarities between rings of segments 102 and ties 200 or 202 are contemplated. In those events tie failure can be caused by disintegration, degradation, chemical reaction or even shape change using shape memory material. An alternative operating mode encompasses stretch of ties 200 or 202 without actual failure. The ties can elastically or plastically deform without shear for example and still provide the added strength to assist in rapid deployment or to counteract residual stress from the additive manufacturing process.

Those skilled in the art will appreciate that alternative backup ring designs are described that have the objective of dimensional growth while limiting or eliminating extrusion of a sealing element on preferably opposed ends of a sealing element. In FIGS. 1-7 alternating circumferential slots with dog leg connectors in the form of a bore extend from the inside diameter and the outside diameter in alternating fashion. On radial expansion the bores shear on surfaces where the bore is a connector to slots that extend from opposed ends of an outer or inner diameter and where the two slots are themselves circumferentially offset by the width of the oblong bore or void. As a result the inside and outside diameters grow as the slots part to form gaps and the offset disposition of slots connected by an oblong bore allows an end surface to be positioned in each gap that minimizes or completely prevents seal element extrusion. The dimensional growth need not be uniform so that the enlarged dimension can conform to an irregularly shaped borehole wall, for example. The adjacent and oppositely facing end walls can interact with each other as a given oblong opening is sheared to expose such end walls so that there is overlap between such adjacent end walls with a stop device that limits relative circumferential movement between them. Alternatively the wall ends can align or pull away from each other slightly so that there is either no extrusion gap or a minimal gap for the sealing element.

The same pattern of slots that open into gaps alternating on the inside and outside diameters can be used with dovetail cuts that have slack in them in the run in diameter and where the relative circumferential movement of each pair of dovetail components is limited by the slack coming out of each dovetail connection. The gaps that open are blocked by the extension of the male of the dovetail pair extending into the opening. The dovetail pairs start in an alternating pattern on the inside and outside diameters to present a cohesive ring structure that can expand on the inside and outside diameters. The dovetail slots on the inside diameters are circumferentially spaced from the dovetail slots on the outside diameter and the gaps that form as the diameters increase are substantially blocked by the male dovetail component bottoming on the female surrounding component or when the outside dimension of the backup ring engages a surrounding tubular, whichever happens first. The structure with alternating dog leg slots or dovetail slots lets the ring remain whole while lending the ring flexibility of going out of round so that if the surrounding tubular has dimensional imperfections, the backup ring can adapt to the actual shape of the inside wall of the surrounding tubular. A single ring can be placed between sealing elements and reduce or eliminate extrusion between the sealing element in either of opposed directions.

In a backup ring with multiple stacked rows of segmented rings the gaps in adjacent rings are offset and all the rings are preferably integral to a common ring base. The extrusion gaps are closed off while the integration of the stacked rings with the base provides for a stronger yet still flexible design that can conform to the surrounding tubular wall for closing an extrusion gap. The outer edge of the stacked rings is made long enough so that there is bending into a more parallel orientation with the surrounding tubular when the set position of FIG. 11 is reached. A support ring can backstop the backup ring in the set position on an opposite side from the sealing element as shown also in FIG. 11. Ties in gaps on one or more rows can give hoop strength for faster running in without swabbing. The ties can resist residual stresses in one or more rows of rings that arise from an additive manufacturing process. Ties can also be located between rows and offset from gaps in each row. The ties can stretch or fail during setting the packer to allow the needed bending to function as an extrusion barrier. Other modes of release by the ties is also contemplated.

Figure 22:
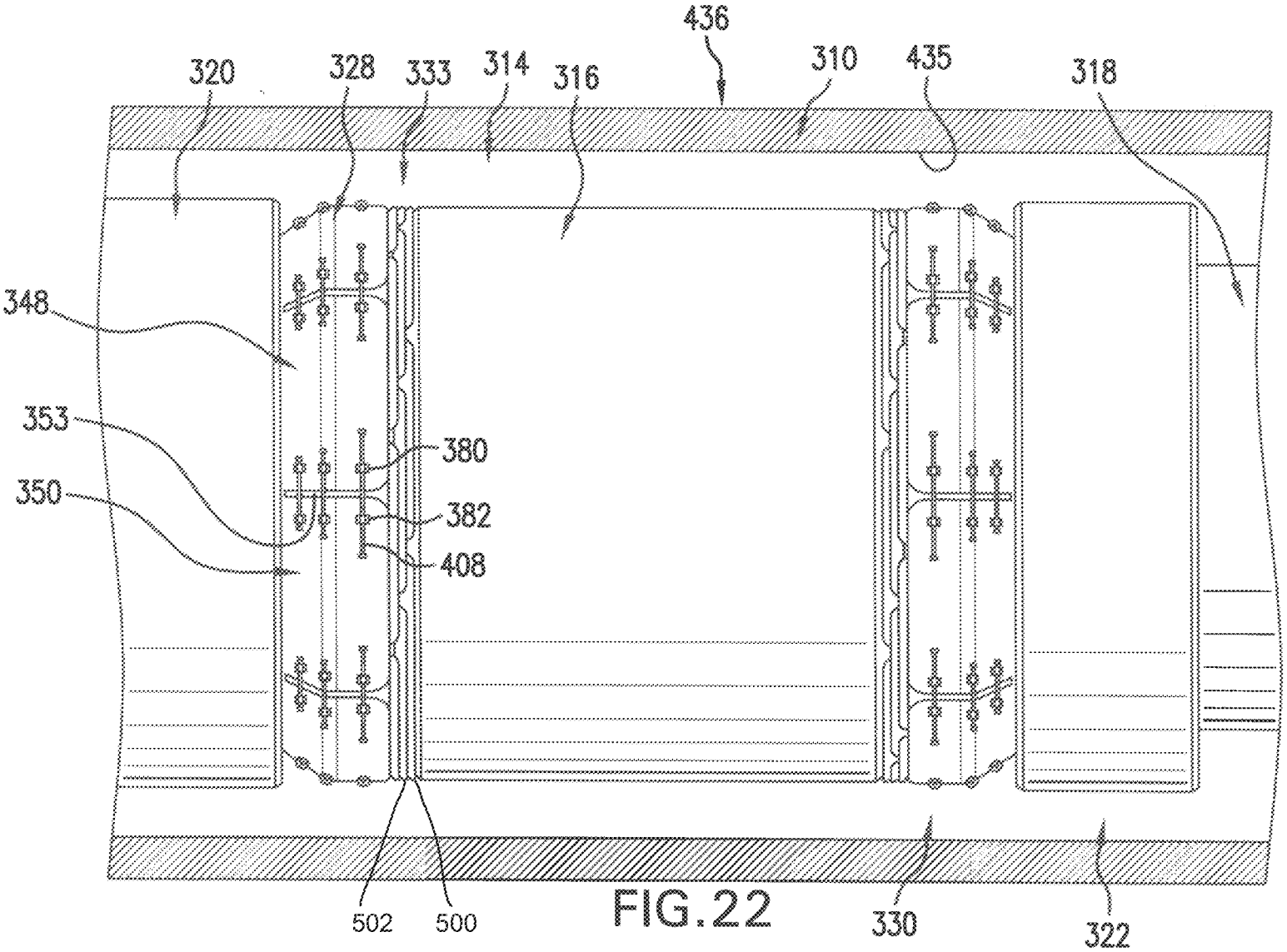
FIG. 22 depicts a sealing system, in accordance with another aspect of an exemplary embodiment.

FIG. 22 depicts a sealing system 310 in accordance with another aspect of an exemplary embodiment. Sealing system 310 includes a sealing element 314 that may take the form of an elastomeric packer 316. Sealing element 314 may be supported by a tubular 318 and arranged between a first gauge ring 320 and a second gauge ring 322. A first backup ring assembly 328 is arranged between sealing element 314 and first gauge ring 320 and a second backup ring assembly 330 is arranged between sealing element 314 and second gauge ring 322. As each backup ring assembly 328 and 330 is substantially similar, a detailed description will follow with reference to FIGS. 23-25 and with continued reference to FIG. 22 in describing first backup ring assembly 328 with an understanding that second backup ring assembly 330 may include similar components.

First backup ring assembly 328 includes a plurality of radially offset ring members 333 including a first or innermost ring member 335, a second ring member 337, a third ring member 339 and a fourth or outermost ring member 341. It should be understood that the number of ring members may vary. Plurality of radially offset ring members 333 may extend from a base ring 343. At this point, it should be understood that plurality of radially offset ring members 333 and base ring 343 may be integrally formed and produced by, for example, an additive manufacturing process.

In an embodiment, fourth ring member 341 may be formed from a plurality of axially extending segments 345 including a first axially spaced segment 348 spaced from a second axially spaced segment 350 by a gap 353. First axially spaced segment 348 includes a first surface portion 360, a second surface portion 362 and a transition region 364 connecting the first surface portion 360 and second surface portion 362. First surface portion 360 is angled relative to second surface portion 362 by transition region 364. Similarly, second axially spaced segment 350 includes a first surface portion 368, a second surface portion 370 and a transition region 372 connecting the first surface portion 368 and second surface portion 370. First surface portion 368 is angled relative to second surface portion 370 by transition region 372.

In accordance with an exemplary aspect first axially extending segment 348 includes a first interlock member support 380 arranged on first surface portion 360 and second axially extending segment 350 includes a second interlock member support 382 arranged on first surface portion 368. First interlock member support 380 includes a first passage 384 and second interlock member support 383 includes a second passage 386 that is generally aligned with first passage 384.

First axially extending segment 348 also includes a third interlock member support 390 having a third passage 391 provided on transition region 364 and second axially extending segment 350 includes a fourth interlock member support 393 having a fourth passage 394 provided on transition region 372. Finally, first axially extending segment 348 includes a fifth interlock member 398 having a fifth passage 399 provided on second surface portion 362 and second axially extending segment 350 includes a sixth interlock member support 402 having a sixth passage 403 arranged on second surface portion 370. Third passage 391 generally aligns with fourth passage 394 and fifth passage 399 generally aligns with sixth passage 403. While shown as being mounted spaced from edges of the corresponding surface portions and transition regions, it should be understood that the interlock members could be connected and/or form on the edges of the axially extending segments.

In an embodiment, first interlock member support 380, second interlock member support 382, third interlock member support 390, fourth interlock member support 393, fifth interlock member support 398, and sixth interlock member support 402 may be individually mounted to the respective ones of first and second axially extending segments 348 and 350 or, in an alternative embodiment, may be integrally formed with, such as by additive manufacturing, with the respective ones of first and second axially extending segments 348 and 350.

In further accordance with an exemplary embodiment, a first interlock member 408 extends between first interlock member support 380 and second interlock member support 382. More specifically, first interlock member 408 may take the form of a pin that extends through first passage 384 and second passage 386. First and second interlock member supports 380 and 382 may shift relative to first interlock member 408. Similarly, a second interlock member 410 extend between third interlock member support 390 and fourth interlock member support 393, and a third interlock member 412 extends between fifth interlock member support 398 and sixth interlock member support 402. As each interlock member 408, 410, and 412 is similarly formed, a detailed description will follow with reference to first interlock member 108 with an understanding that second interlock member 410, and third interlock member 412 may be similarly formed.

First interlock member 408 includes a first end 417, a second end 419, and an intermediate portion 421 extending between and connected with first end 417 and second end 419. First end 417 is provided with a first head or travel limiter 429 and second end 419 is provided with a second head or travel limiter 431. First head 429 or second head 431 may be integrally formed with first interlock member 408. Second head 431 may be formed separately from and attached to first interlock member 408 after installing.

Figure 23:
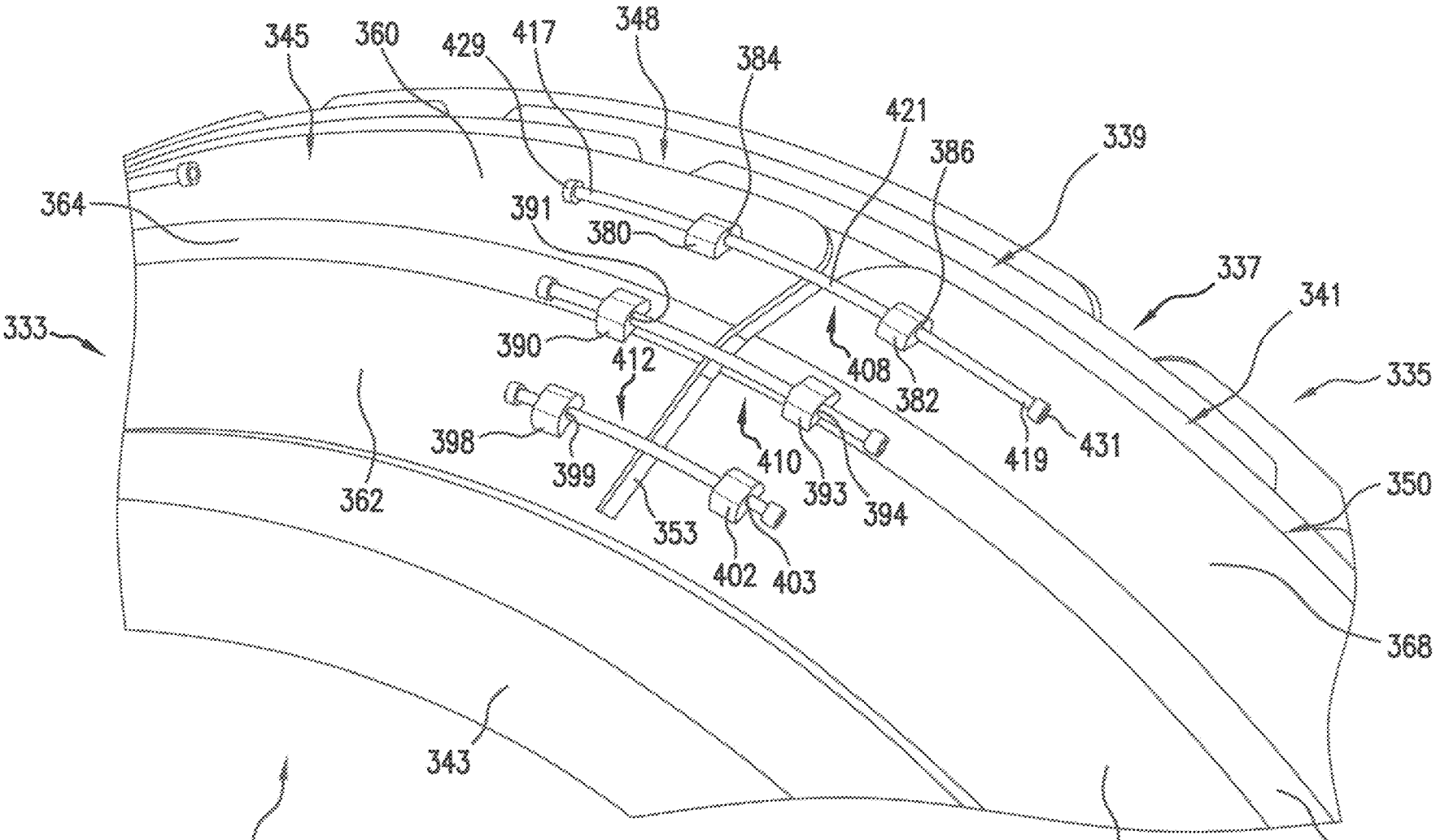
FIG. 23 depicts a backup ring assembly of the sealing system of FIG. 22.

As shown in FIG. 23, first interlock member 408 is installed into first and second passages 384 and 386 such that first head 429 is spaced from first interlock member support 380 and second head 431 is spaced from second interlock member support 382. Second interlock member 410 is installed into third and fourth passages 391 and 394, and third interlock member 412 is installed into fifth and sixth passages 399 and 403 in a similar manner. In this configuration, sealing system 310 is in a run in position.

Figure 24:
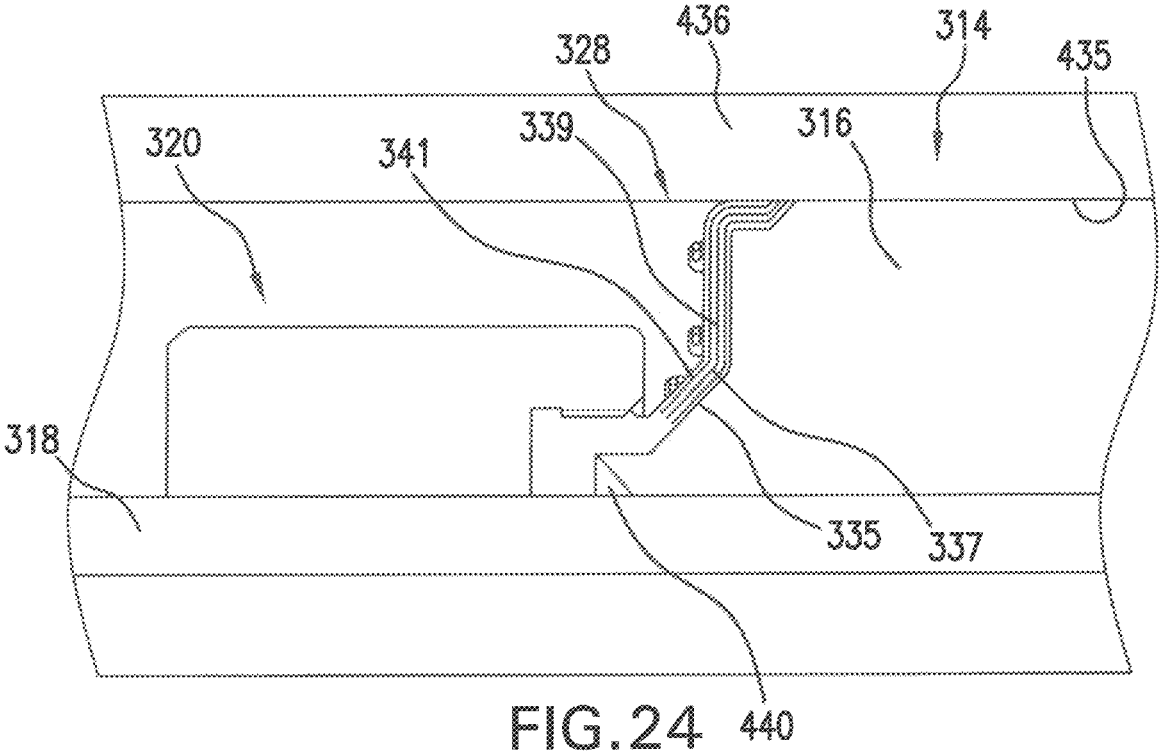
FIG. 24 depicts a cross-sectional side view of the sealing system of FIG. 22 in a deployed configuration.
Figure 25:
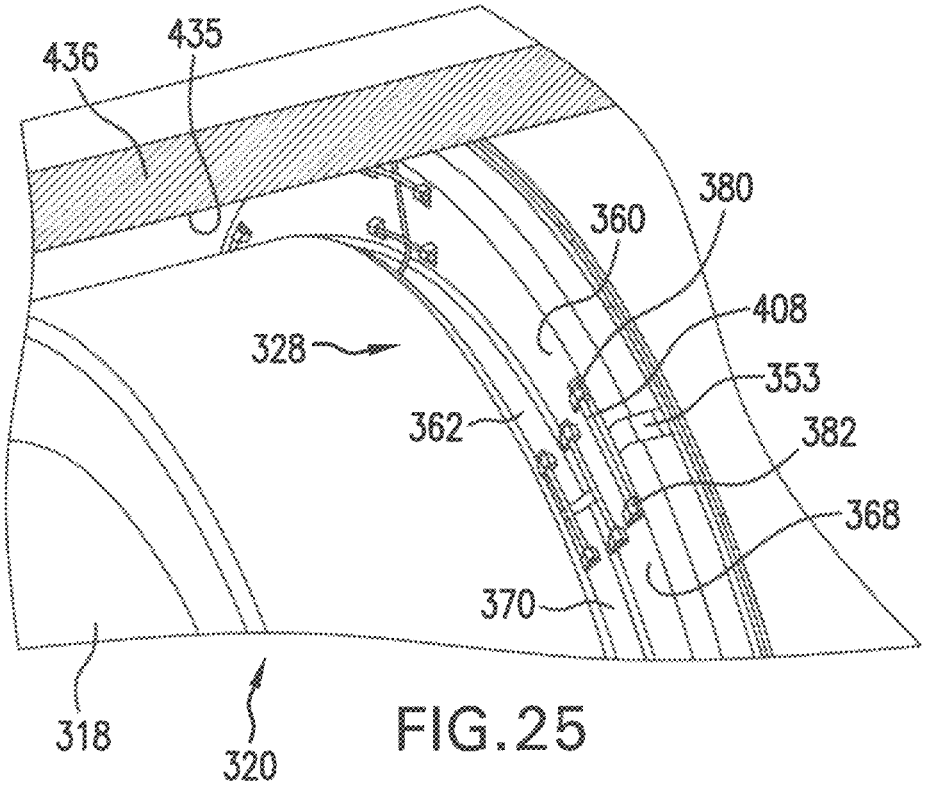
FIG. 25 depicts a partial perspective view of the backup ring of FIG. 23 in the deployed configuration.
Figure 26:
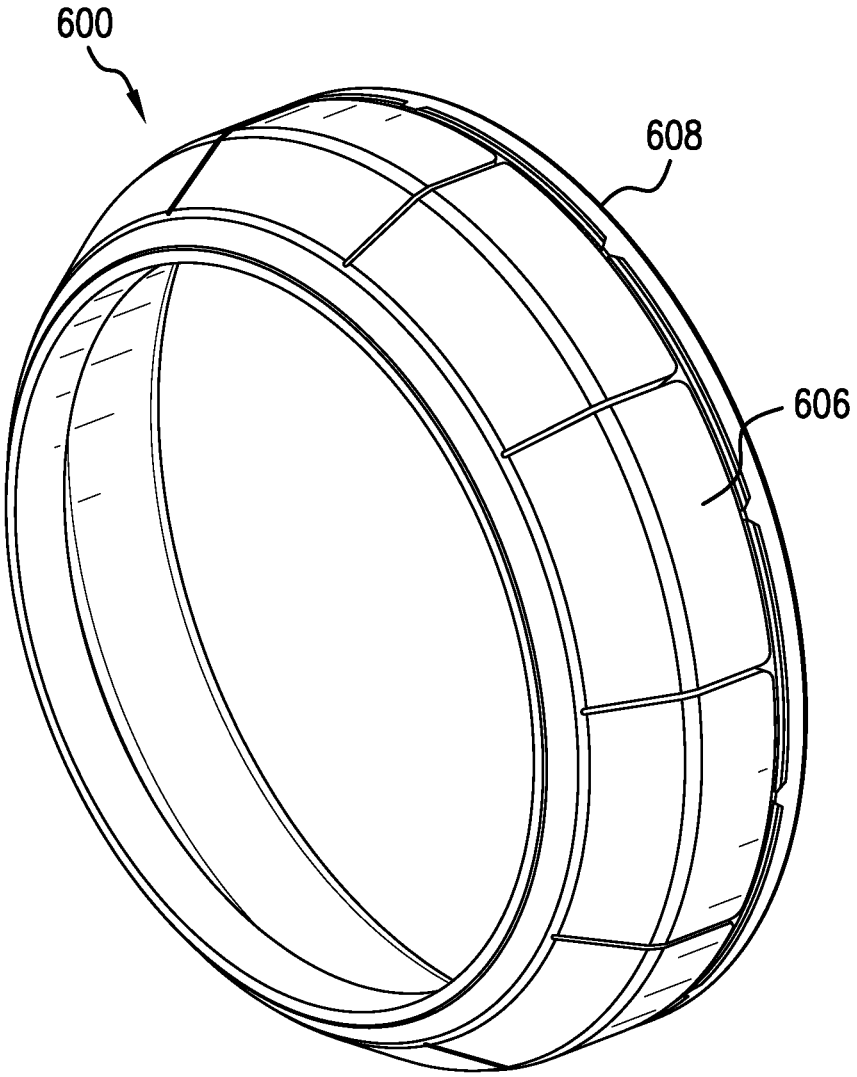
FIG. 26 depicts a perspective view of another embodiment of backup ring.
Figure 27:
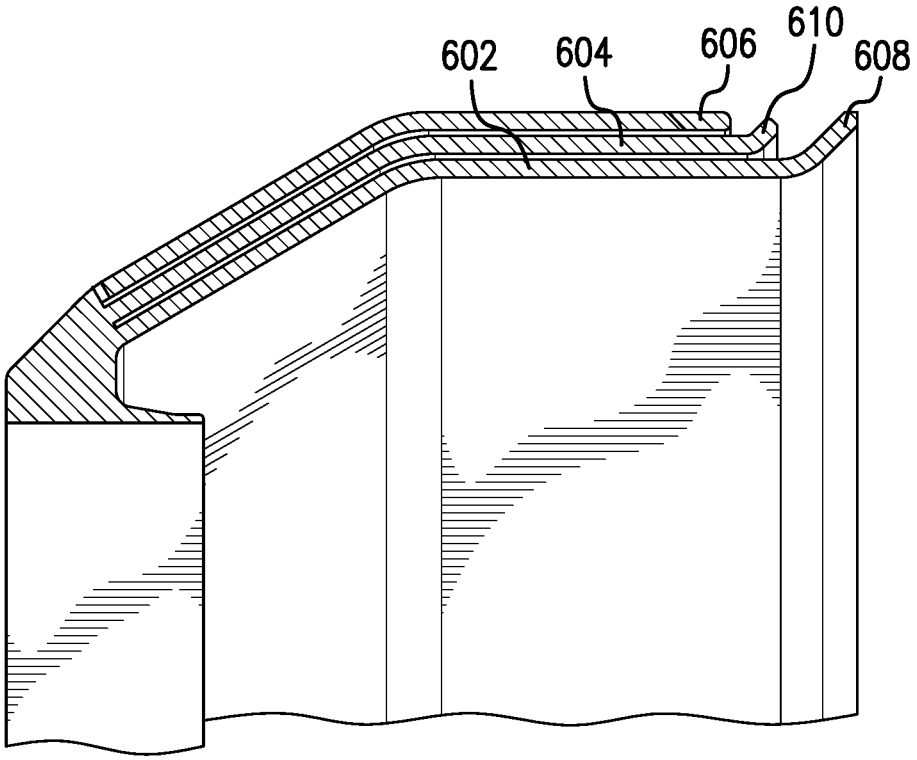
FIG. 27 is a partial cross sectional view of the backup ring shown in FIG. 26.
Figure 28:
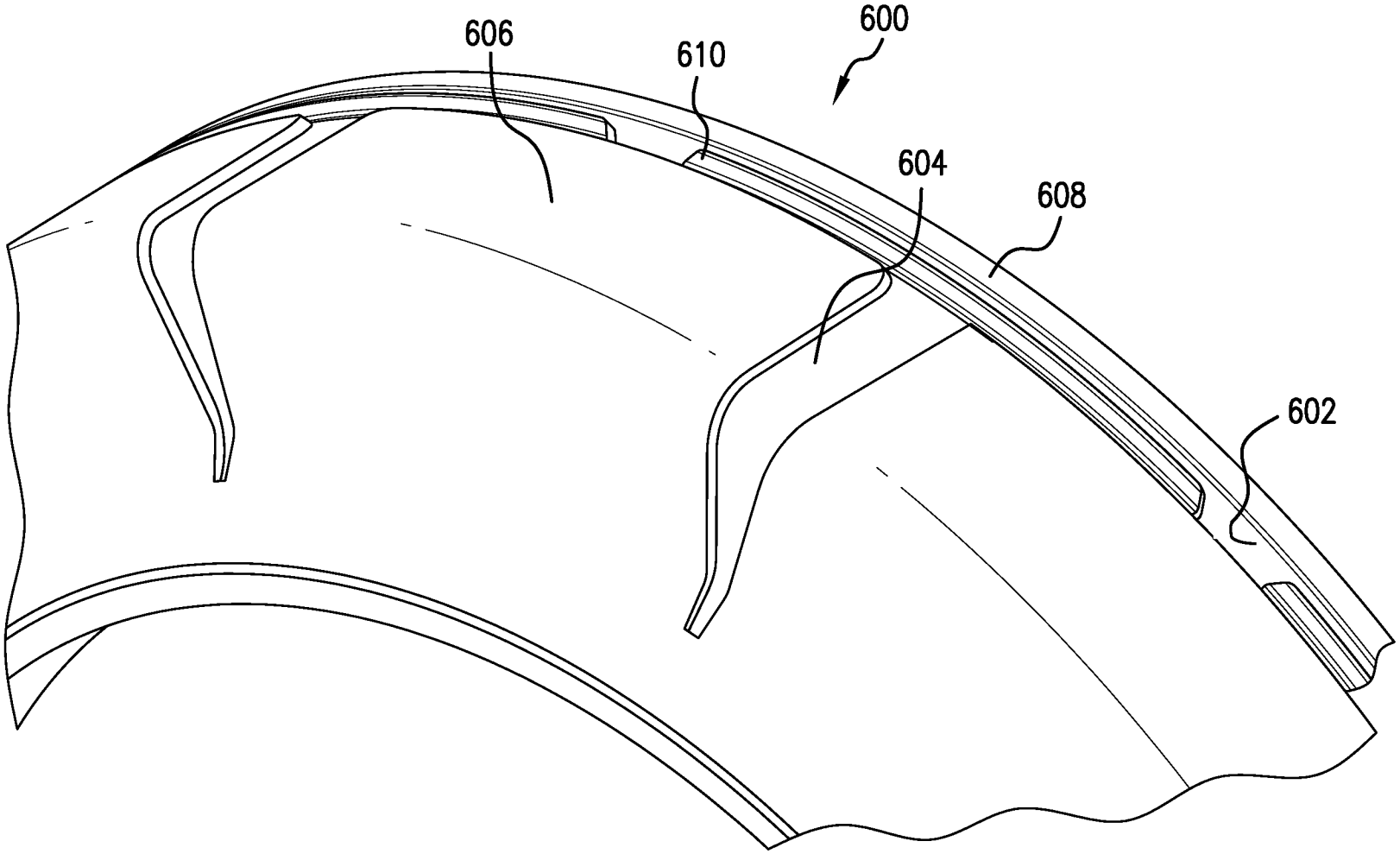
FIG. 28 is a perspective view of the ring of FIG. 26 illustrated as it would be if disposed in a seal system and in the set position.
Figure 29:
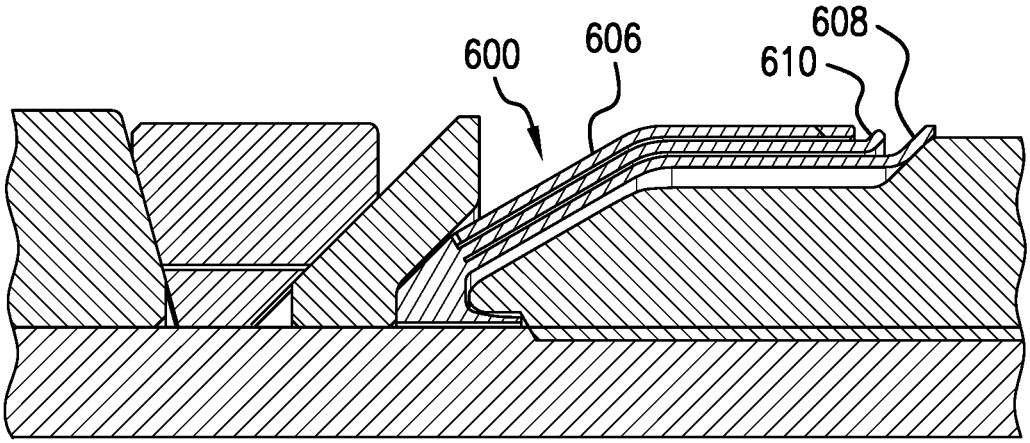
FIG. 29 is a cross sectional view of a seal system similar to others described herein and illustrating the backup ring of FIG. 26 in a run in position.

Sealing system 310 is introduced into the wellbore and shifted to a selected depth/location. At this point, sealing element 314 may be expanded radially outwardly into contact with an inner surface 435 of tubular 436. During expansion of sealing element 314, first and second backup rings 320 and 322 shift axially resulting in a radial expansion as shown in FIGS. 24 and 25.

First, second, and third interlock members 408, 410, and 412 limit circumferential expansion of the plurality of axially extending segments 345. Thus ensuring that gap 353 does not grow beyond a selected dimension. In this manner, extrusion of sealing element 314 may be reduced. Further, sealing system 310 may include an anti-extrusion ring 440 (FIG. 24) arranged radially inwardly of base ring 372. Anti-extrusion ring 440 limits extrusion of sealing element 314 between base ring 372 and tubular 318.

Further to be appreciated is that the backup may also include one or more terminal flare sections 500, 502 that transitions from a more axially extending direction to a more radially extending direction, which may be appreciated in each of FIGS. 21-24 (and numbered in FIG. 22). Each of the terminal flare sections 500, 502, etc. extends from a ring member and collectively circumferentially creates an operative flare circle that interacts with the elastomeric packer 316 upon setting of the seal system 310 to ensure a loaded contact with a tubular surface into which the seal system 310 is set. The one or more terminal flare sections 500, 502, etc. Substantially improve extrusion resistance of the seal system 310. In embodiments, the flare section will transition from a more axially extending direction to a more radially extending direction by >0 degrees to 90 degrees over its axial length when measured with a base of the angle laid axially along the segment to the direction of an end of the terminal flare section 500, 502, etc. In the particular embodiments illustrated in FIG. 22. The angle is about 90 degrees. The angle as illustrated in FIGS. 21 and 23 is about 45 degrees.

Figure 30:
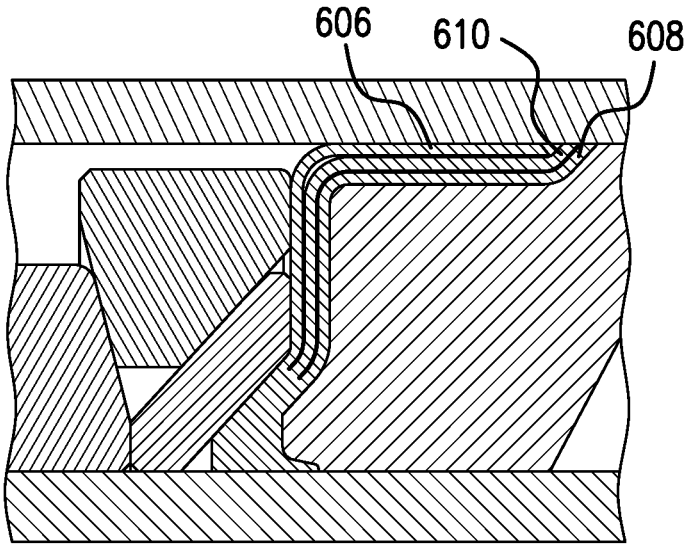
FIG. 30 is an enlarged view of the system illustrated in FIG. 29 showing the backup ring in the set position.

Referring to FIGS. 26-29, an additional embodiment of a backup ring 600 is illustrated. The ring 600 includes a plurality of ring members 602, 604 and 606 as in previous embodiments but it is to be noted that that most radially inward ring member 602 is a 360 degree continuous ring member. This ring member 602 enhances the antiextrusion properties while still allowing for a relatively lower setting force. Ring 602 is to be directly in contact with an elastomeric packer such as packer 316 illustrated in other figures. Also similar to other figures, the ring 600 may include terminal flare sections 608 and 610, for example, that transition from a more axially extending direction to a more radially extending direction. In other respects, the ring 600 may exhibit any of the features of the foregoing embodiments. This embodiment is illustrated in various stages of deployment in FIGS. 28-30.

Set forth below some embodiments of the foregoing disclosure.

Embodiment 1

A backup ring assembly including a base ring, a plurality of ring members extending from the base ring wherein at least a radially inwardly most ring member of the plurality of ring members includes a depending terminal flare section that transitions from a more axially extending direction to a more radially extending direction.

Embodiment 2

The backup ring assembly as in any prior embodiment, wherein two of the plurality of ring members include flare sections that transitions from a more axially extending direction to a more radially extending direction.

Embodiment 3

The backup ring assembly as in any prior embodiment, wherein an outermost of the plurality of ring members includes a plurality of axially extending segments.

Embodiment 4

The backup ring assembly as in any prior embodiment, wherein the flare transitions by >0 to 90 degrees over its axial length.

Embodiment 5

The backup ring assembly as in any prior embodiment, wherein the two flare sections parallel one another as they extend.

Embodiment 6

The backup ring assembly as in any prior embodiment, wherein the radially inwardly most ring member is circumferentially continuous.

Embodiment 7

A backup ring assembly including a base ring, a plurality of ring members extending from the base ring wherein at least one ring member of the plurality of ring members is circumferentially continuous and at least one other ring member is segmented.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A backup ring assembly comprising:

a base ring;

a plurality of ring members extending from the base ring wherein at least a radially inwardly most ring member of the plurality of ring members includes a depending terminal flare section that transitions from a more axially extending direction to a more radially extending direction, wherein the radially inwardly most ring member is circumferentially continuous.

2. The backup ring assembly as claimed in claim 1 wherein two of the plurality of ring members include flare sections that transitions from a more axially extending direction to a more radially extending direction.

3. The backup ring assembly as claimed in claim 2 wherein the two flare sections parallel one another as they extend.

4. The backup ring assembly as claimed in claim 1 wherein an outermost of the plurality of ring members includes a plurality of axially extending segments.

5. The backup ring assembly as claimed in claim 1 wherein the flare transitions by >0 to 90 degrees over its axial length.

6. A backup ring assembly comprising:

a circumferentially continuous base ring;

a plurality of ring members extending from the base ring wherein at least one ring member of the plurality of ring members is circumferentially continuous and at least one other ring member is segmented.

7. The backup ring assembly as claimed in claim 6 wherein the base ring and the plurality of ring members are all part of one single unitary piece.

* * * * *